US005529384A

United States Patent [19]

Ojanen et al.

[11] Patent Number: 5,529,384

[45] Date of Patent: Jun. 25, 1996

[54] BIT HOLDER BLOCK AND CUTTER BIT THEREFOR

[75] Inventors: Randall W. Ojanen, Bristol, Tenn.; Douglas Bise, Chilhowie, Va.

[73] Assignee: Rogers Tool Works, Inc., Evans, Ga.

[21] Appl. No.: 295,572

[22] Filed: Aug. 25, 1994

[51] Int. Cl.[6] ..... E21C 35/19

[52] U.S. Cl. ..... 299/107

[58] Field of Search ..... 299/86, 91, 92, 299/93

[56] References Cited

U.S. PATENT DOCUMENTS

| | | | |
|---|---|---|---|
| 3,749,449 | 7/1973 | Krekeler | 299/93 |
| 3,841,708 | 10/1974 | Kniff et al. | 299/86 |
| 3,992,061 | 11/1976 | Rollins | 299/86 |
| 4,302,055 | 11/1981 | Persson | 299/93 |
| 4,343,516 | 8/1982 | Aden | 299/86 |
| 4,415,208 | 11/1983 | Goyarts | 299/91 |
| 4,944,560 | 7/1990 | Osterwise | 299/91 |

OTHER PUBLICATIONS

Product Information Sheet of EIMCO, A Tamrock Co., Fairmont WV of Products Model 2810–1 and 5810; (Date Unknown).

*Primary Examiner*—David J. Bagnell

*Attorney, Agent, or Firm*—Dickstein, Shapiro & Morin

[57] ABSTRACT

A bit holder block is provided composed of a foot portion for being received in a seat of a rotary member and a bit holder portion for releasably holding a cutter bit with respect to a bit bore therein. The bit bore has a forward opening at a bit abutment face of the bit holder block. The cutter bit is provided with an annular abutment surface for abutting the bit abutment face. A bit retainer port is provided in the bit holder block located at, and communicates with, a rear opening of the bit bore for therein securing a retainer clip to an annular groove in the cutter bit. A rear segment of the bit holder block provides a strong reinforcing structure for the area around the rear opening of the bit bore which counters a fulcrum force generated at the rear opening of the bit bore, the fulcrum force arising during operation due to a resultant force acting on the cutter bit being directed below the axis of the cutter bit, rather than above it, as was previously believed in the art.

11 Claims, 3 Drawing Sheets

BIT HOLDER BLOCK AND CUTTER BIT THEREFOR

BACKGROUND OF THE INVENTION

1. Field of the Invention:

The present invention relates to a bit holder block and cutter bit therefor of the type used particularly in mining operations. More particularly, the present invention relates to a bit holder block and cutter bit therefor of the aforesaid class which is structured to provide resistance to bit holder block cracking during mining operations.

2. Description of the Related Art:

Typical mining operations, such as the removal of coal along a seam, are performed by a mining apparatus which drives a rotary member provided with a plurality of cutting tips. The cutting tips engage a surface being mined to thereby cause removal of material from the surface. Conventional cutting tips are constructed of a hardened material, such as carbide. The cutting tip is connected to a conical head located at a forward end of an elongated rod, the combination collectively forming a cutter bit. Each cutter bit must be located in a predetermined orientation with respect to the rotary member of the mining apparatus. Because mining operations involve severe wear and tear on the cutter bit, it has become the practice to provide bit holder blocks for replaceably receiving, respectively, each of the cutter bits. It has further become the practice that because of the wear and tear experienced also by the bit holder blocks, that the bit holder blocks are structured for being replaceably connected with respect to the rotary member. Examples of replaceable bit holder blocks and cutter bits are described in U.S. Pat. No. 3,749,449 to Krekeler, U.S. Pat. No. 3,841,708 to Kniff et al., U.S. Pat. No. 3,992,061 to Rollins, U.S. Pat. No. 4,302,055 to Persson, U.S. Pat. No. 4,343,516 to Aden, and U.S. Pat. No. 4,415,208 to Goyarts.

In order for a bit holder block to provide a satisfactory service life, it must be structured so as to adequately handle the forces acting on it as a result of its cutter bit engaging a surface being mined. Ordinarily, the cutter bit is of an elongated cylindrical shape, and the bit holder block is provided with a cylindrical bore into which the cutter bit is received. The cutter bit is ordinarily retained at a predetermined abutting relationship with respect to the bit holder block via a first fastener. The bit holder block is ordinarily provided with surfaces which interface with cooperating surfaces on the rotary member for anchoring the bit holder block thereto in conjunction with one or more second fasteners or weldment.

As exemplified by the disclosure in Goyarts (cited hereinabove) and depicted in FIG. 7A, the conventional theory of force distribution on the cutter bit CB with respect to the bit holder block HB under mining loads was that the resultant cutter bit force F' was directed above the axis A of the cutter bit. This conventional theory presumed that the magnitude of the cutting force $F_c'$ on the cutter bit was larger than the magnitude of the normal force $F_n'$ on the cutter bit. Accordingly, prior bit holder block structures have been provided for accommodating this direction of the resultant cutting bit force F'.

However, applicants have observed the location and development of stress cracks in bit holder blocks after a period of usage. These field observations have led applicants to the realization that the conventional theory of the force distribution is in error because the magnitude of the normal force actually exceeds the magnitude of the cutting force. As indicated in FIG. 7B, it has been determined by applicants that in order to be correct, the theory of force distribution must properly take into account the correct relative magnitudes of the cutting and normal forces $F_n$, $F_c$ on the cutter bit. An analysis of the direction and magnitude of these forces has led applicants to the realization that the true resultant cutter bit force F is directed below the axis A of the cutter bit.

Accordingly, the present invention is a bit holder block which provides a structure which takes into account the true resultant cutter bit force F.

SUMMARY OF THE INVENTION

The present invention is an improved bit holder block and cutter bit therefor which takes into proper account the actual forces acting on the bit holder block during mining operations.

The bit holder block according to the present invention is composed of a singular metallic piece, as for example steel. A foot portion thereof is generally V-shaped and is provided with a plurality of surfaces for abutting cooperatively dimensioned and located surfaces of a seat formed in a rotary member. A bore is provided transversely in the foot portion. A bit holder portion of the bit holder block is located opposite the foot portion thereof. The bit holder portion is provided with a bit bore for receiving thereinto the cutter bit according to the present invention. A forward end of the bit holder portion is provided with a bit abutment face. A forward opening of the bit bore is substantially medially located with respect to the bit abutment face. A bit retainer access port is provided in the top of the bit holder portion, spaced with respect to the rear end of the bit holder block. The bit retainer access port communicates with a rear opening of the bit bore.

The cutter bit according to the present invention is provided with a conically shaped head, tipped with a hardened material. The conically shaped head terminates in an annular abutment surface for abutting the aforesaid bit abutment face. An elongate body extends axially from the annular abutment surface for being received within the aforesaid bit bore. An annular groove is provided adjacent the end of the cutter bit opposite the conical head and is located so as project out of the rear end of the bit bore and into the aforesaid bit retainer access port when the elongate body is fully received in the bit bore. A retainer clip is provided for engaging the annular groove to thereby interferingly retain the elongate body seated within the bit bore.

As depicted in FIG. 7B, the true resultant cutting bit force F acting on the bit holder block 12 is directed below the axis A of the cutter bit 14. The true resultant cutting bit force F resolves into two components with respect to the bit holder block, a bit axial force $F_a$ and a bit transverse force $F_x$. The bit axial force $F_a$ is resisted by the bit abutment face 40 of the bit holder block with respect to the annular abutment surface 58 of the cutting bit. However, the bit transverse force $F_x$ creates a bending moment on the cutter bit. As a result of this bending moment, the bit holder block is caused to serve as a fulcrum at point $P_f$ of the bit bore 50 with a consequent fulcrum moment force $F_f$ acting on the bit holder block at the bit bore adjacent the bit retention access port 52. With this theory in mind, the present invention is a bit holder block providing increased structural strength at a rear segment 64 of the bit holder block extending from the retainer access point 52 to the rear surface 28 thereof in order to provide added regional strength sufficient to resist the fulcrum moment force $F_f$.

Accordingly, it is an object of the present invention to provide a bit holder block for holding a cutting bit having increased structural strength at the rear segment of the bit holder block to adequately resist the fulcrum moment force generated thereat.

It is a further object of the present invention to provide a bit holder block and cutting bit therefor wherein the bit holder block is resistive to forces generated on the cutter bit during operation, specifically fulcrum moment force and cutter bit axial force.

These and additional objects, features and benefits will become clear from the following description.

BRIEF DESCRIPTION OF THE DRAWING

FIGS. 7A and 7B are side views of a bit holder block and cutting bit combinations according to the present invention, wherein FIG. 7A shows theoretical forces acting thereupon during operation thereof according to conventional theory, and wherein FIG. 7B shows actual forces acting thereupon during operation according to the present theory set forth herein.

DETAILED DESCRIPTION OF THE PREFERRED EMBODIMENT

Figure 1:
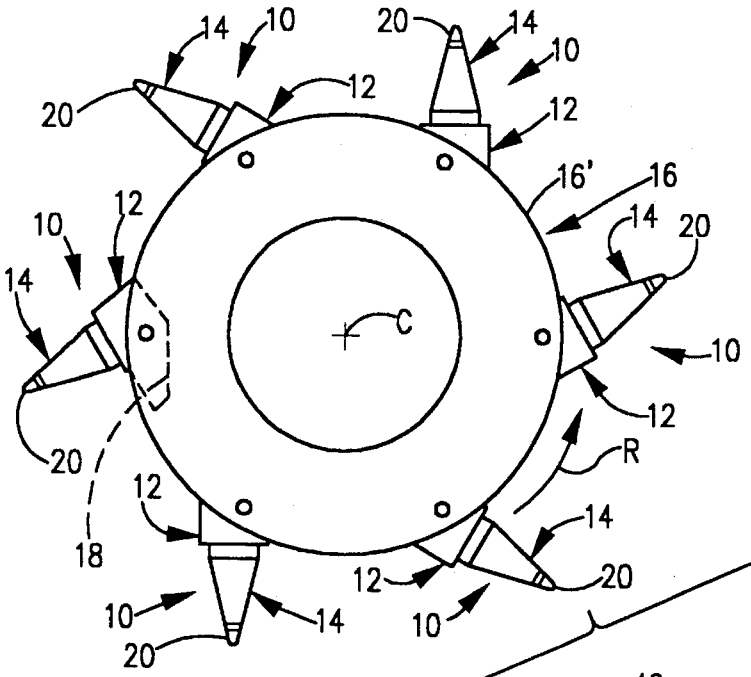
FIG. 1 is a side view of a plurality of bit holder block and cutter bit combinations according to the present invention, shown installed with respect to a rotary member of a mining apparatus.

Referring now to the Drawing, FIG. 1 generally depicts a plurality of bit holder block and cutting bit combinations 10 according to the present invention, shown in a typical environment of operation in which each bit holder block 12 and cutter bit 14 thereof are connected to a rotary member 16 of a conventional mining apparatus (not shown). It will be noted that the rotary member 16 has a periphery 16' at which is provided a plurality of seats 18 recessed thereinto, wherein each seat receives a respective bit holder block 12. The cutter bits 14 are each provided with a predetermined orientation with respect to the periphery 16' so that as the rotary member 16 rotates about a center axis C in the direction of arrow R, the cutting tip 20 of each of the cutter bits 14 will engage a surface (not shown) to be mined or otherwise worked.

Referring now additionally to FIGS. 2 through 6 and 7B, the structure and function of the bit holder block and cutter bit combination 10 according to the present invention will be detailed with greater specificity.

Figure 2:
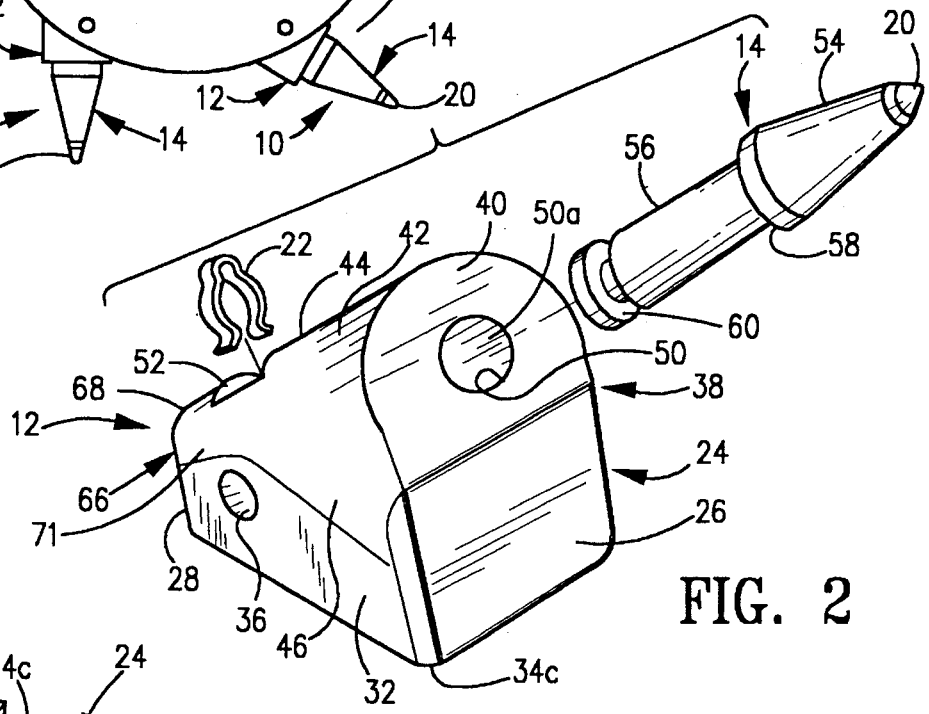
FIG. 2 is a perspective, exploded view of the bit holder block and cutter bit combination according to the present invention.

As depicted in FIG. 2, the bit holder block 12 and cutter bit 14 of each bit holder block and cutter bit combination 10 is structured[ such that the cutter bit is releasable from the bit holder block, the releasability of which, as described hereinbelow, is controlled by a retainer clip 22.

The bit holder block 12 according to the present invention is composed of a singular metallic piece. An example of a suitable construction material is steel, preferably AISI 864OH, but other suitably strong and durable materials can also be used. The bit holder block 12 is structured in a predetermined configuration which provides strength at locations of known stress caused by the forces acting on the cutter bit 14 during operation, as will be discussed in detail hereinbelow.

Figure 5:
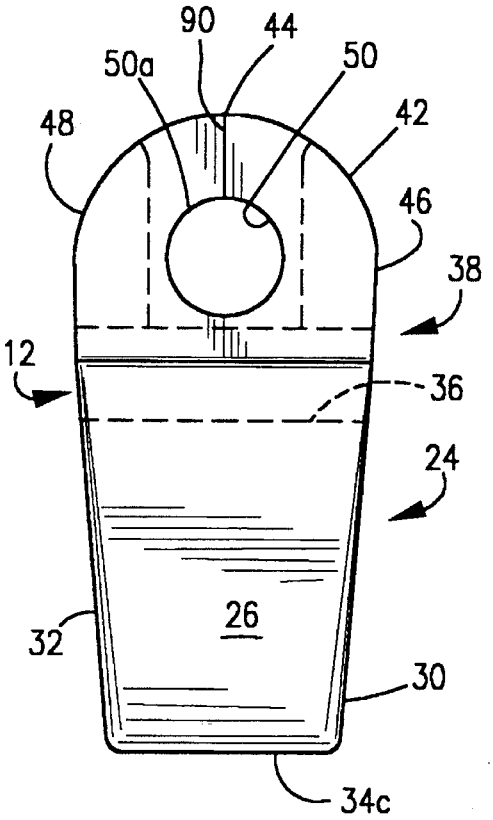
FIG. 5 is a front elevational view of the bit holder block according to the present invention.
Figure 6:
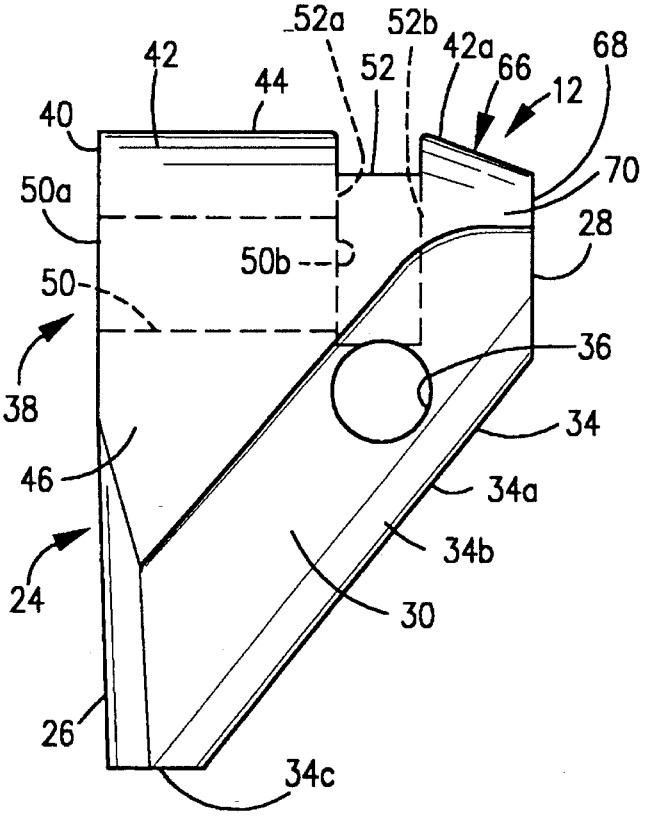
FIG. 6 is a left side elevational view of the bit holder block according to the present invention.

A foot portion 24 of the bit holder block 12 is generally V-shaped and is provided with a plurality of surfaces, as follows: a flat front surface 26, a flat rear surface 28 located opposite the front surface, a flat left surface 30, a flat right surface 32 located opposite the left surface, and a bottom surface 34 located contiguous the aforementioned surfaces, as shown in FIGS. 5 and 6, for abutting cooperatively dimensioned and oriented surfaces of a respective seat 18 formed in a rotary member 16. The bottom surface 34 has a flat central portion 34*a* and contiguous the left and right surfaces 30, 32, the bottom surface is provided, respectively, with chamfered side portions 34*b*, the chamfer angle being preferably forty-five degrees with respect to the central portion. Similarly, the bottom surface 34 contiguous the front surface 26 is preferably provided with a chamfered front portion 34*c*, the chamfer angle being preferably forty-five degrees with respect to the central portion 34*a*. Each of the left and right surfaces 30, 32 are mutually diverging with increasing distance from the bottom surface 34. A preferred angle of each of the left and right surfaces 30, 32 with respect to the central portion 34*a* of the bottom surface 34 is seventy-eight degrees, wherein the left and right surfaces mutually diverge at an angle of 24 degrees. The front surface 26 is angled substantially at ninety degrees with respect to the front portion 34*c* of the bottom surface 34; that is, substantially at forty-five degrees with respect to the central portion 34*a* of the bottom surface. The rear surface 28 is oriented parallel with respect to the front surface 26. Bore 36 extends through the bit holder block 12 having openings thereof at each of the left and right surfaces 30, 32 substantially near the rear surface 28, the exact location of which will be explained hereinbelow.

Figure 4:
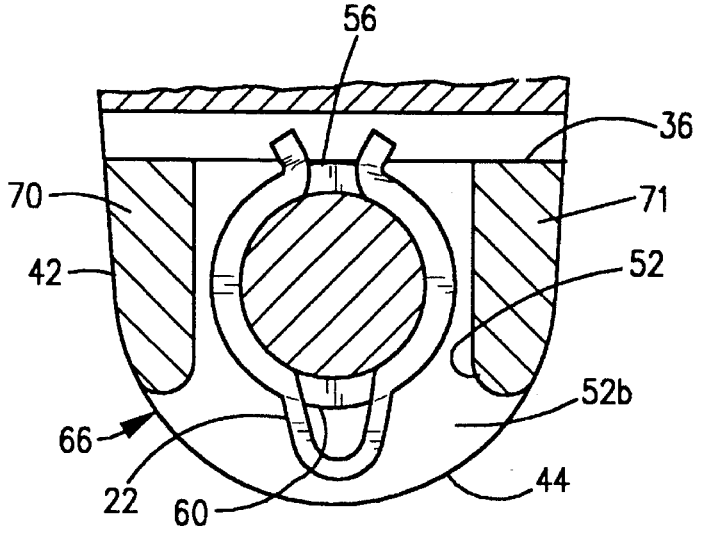
FIG. 4 is a partly sectional view of the bit holder block and outer bit combination according to the present invention, seen along line 4—4 in FIG. 3.

A bit holder portion 38 of the bit holder block 12 is located opposite the foot portion 24 thereof. The bit holder portion 38 is provided with a bit abutment face 40 which contiguously meets the front surface 26 at an angle of preferably fourteen degrees with respect thereto, as generally shown in FIG. 2. The bit holder portion 38 further has a radiused top surface 42 which smoothly curves over one-hundred-eighty degrees, the apex 44 of which forms a line along its length that is at an angle of preferably fifty degrees with respect to the central portion 34*a* of the bottom surface 34. The top surface 42 meets the bit abutment face 40 and the rear surface 28, and meets the left and right surfaces 30, 32, respectively, via left and right sidewalls 46, 48 which are progressively increasing in size toward the bit abutment face 40. A bit bore 50 is provided in the bit holder portion 38, wherein the forward opening 50*a* thereof is located substantially medial with respect to the bit abutment surface 40. The bit bore 50 extends interiorly in perpendicular relation to the bit abutment surface 40, and terminates at a rear opening 50*b*. A bit retainer access port 52 is provided in the top surface 42 of the bit holder portion 38, a rear sidewall 52*b* thereof being spaced from, but substantially near, the rear end 28. In this regard, the bit retainer access port 52 communicates with the rear opening 50*b* of the bit bore 50 at a front sidewall 52*a* thereof. Further in this regard, bore 36 adjoins the bit retainer access port 52, wherein the bore communicates with the bit retainer access port 52 so as to provide, as shown in FIG. 4, clearance for the retainer clip 22. Preferably, the rear section 42*a* of the top surface 42 is provided with a chamfer between the retainer access port 52 and the rear surface 28.

The cutter bit 14 according to the present invention is provided with a conically shaped head 54 to which is connected a hardened material tip 20, such as, for example, carbide. The conically shaped head 54 connects with an elongated body 56 having a cross-section less than that of the conically shaped head at the connection therebetween. The difference in cross-sections of the elongated body 56 and the conically shaped head 54 define an annular abutment surface 58. In this regard, the elongated body 56 is dimensioned to be received within the bit bore 50, wherein, when fully received thereinto, the annular abutment surface 58 abuts the bit abutment face 40 of the bit holder block 12. An annular groove 60 is provided adjacent the end 64 of the elongated body 56 opposite the conical head 54. The annular groove 60 is located so that when the elongated body 56 is fully received into the bit bore 50, the elongated body projects out of the rear opening 50*b* and into the bit retainer access port 52, whereupon the annular groove is situated within the bit retainer access port. The retainer clip 22 is placed through the bit retainer access port 52 and engaged in a selectively removable manner with the annular groove 60. The retainer clip 22 interferingly abuts the front sidewall 52*a* of the bit retainer access port 52 adjacent the rear opening 50*b* of the bit bore 50, thereby preventing extraction of the cutter bit 14 therefrom.

Figure 3:
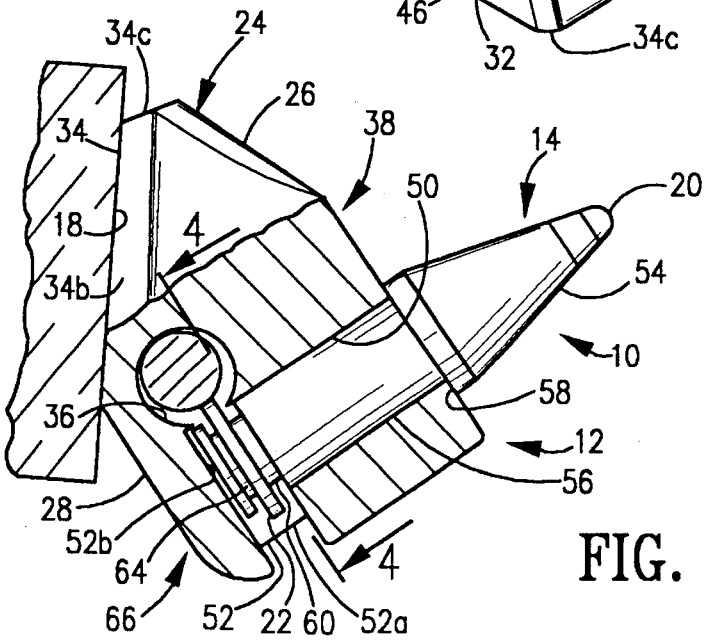
FIG. 3 is a partly sectional side view of the bit holder block and cutter bit combination according to the present invention, shown installed with respect to the rotary member of the mining apparatus of FIG. 1.

In operation, the bit holder block 12 is welded to the rotary member 16 along surfaces 34*a*, 34*b*, 34*c* and surface 28. The cutter bit 14 is installed by placing the elongated body 56 into the bit bore 50 until the annular abutment surface 58 abuts the bit abutment face 40. Then the retainer clip 22 is placed onto the annular groove 60 by passage thereof through the bit retainer access port 52. In this regard, the end 64 of the elongated body 56 adjacent the annular groove 60 does not contact the rear sidewall 52*b* of the bit retainer access port 52 when the annular abutment surface 58 abuts the bit abutment surface 40, as shown in FIG. 3.

It will be noted that to replace cutter bits, all that needs to be done is to remove the retainer clip from the retainer access port and then extract to cutter bit from the bit bore.

Figure 7A:
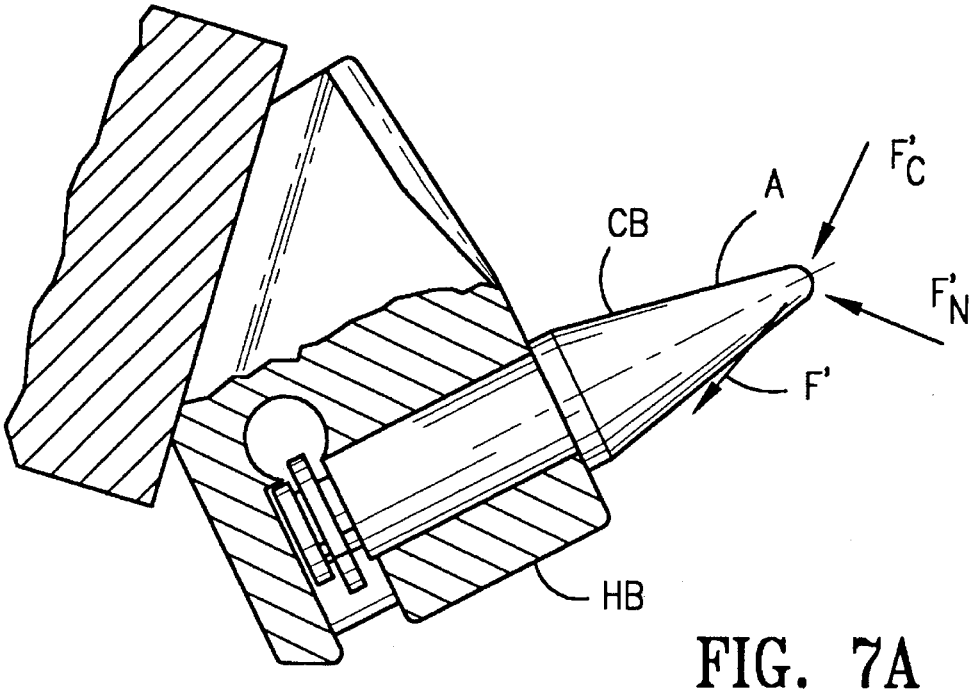
Figure 7B:
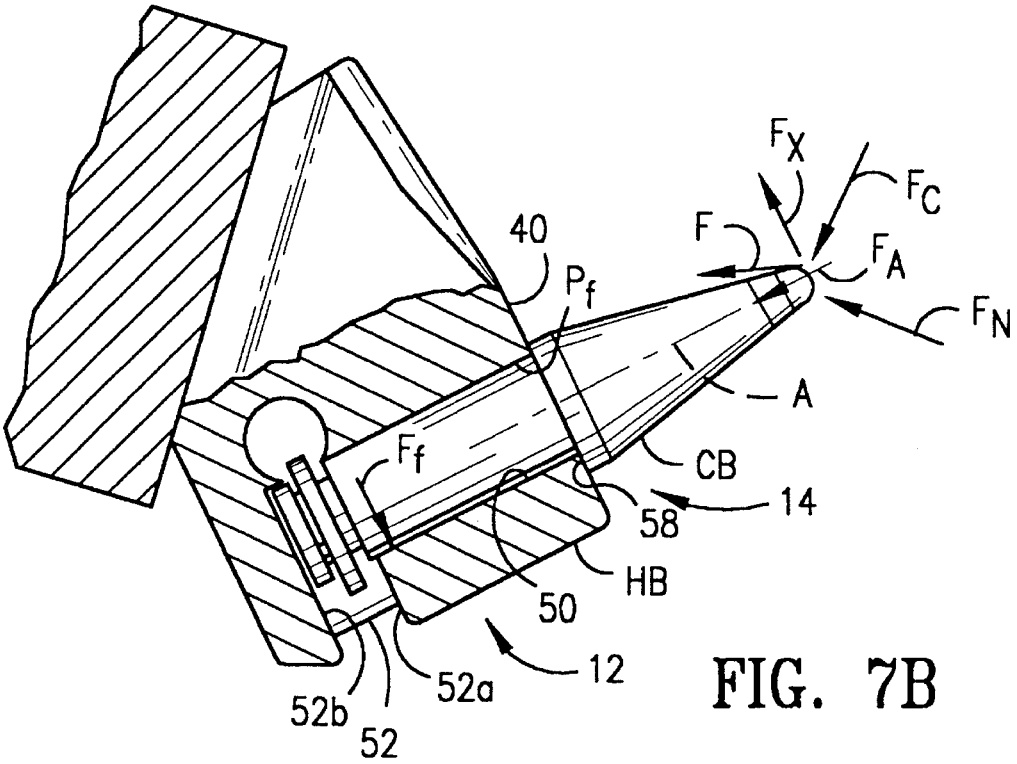

As indicated in FIG. 7B, a major aspect of the present invention is to provide a bit holder block 12 which is structured to take into account the true resultant force F acting on the cutter bit 14 as it is operatively engaging a surface. Since the magnitude of the cutter bit normal force $F_n$ exceeds the magnitude of the force $F_c$, the resultant cutter bit force F acting on the bit holder block 12 is directed below the axis A of the cutter bit 14. The resultant cutter bit force F resolves into two components with respect to the bit holder block 12, these being a bit axial force $F_a$ and a bit transverse force $F_x$. The bit axial force $F_a$ is resisted by the bit abutment face 40 of the bit holder block with respect to the annular abutment surface 58 of the cutter bit 14. However, the bit transverse force $F_x$ creates a bending moment on the cutter bit. As a result of this bending moment, the bit holder block 12 is caused to serve as a fulcrum at point $P_f$ of the bit bore 50 with a consequent fulcrum moment force $F_f$ acting on the bit holder block at the bit bore adjacent the bit retention access port 52.

With this theory of force distribution in mind, the present invention provides a bit holder block with increased structural strength at the rear portion of the bit holder block to thereby resist the fulcrum moment force $F_f$.

In this regard, as depicted in FIG. 3, the bit holder block 12 is provided with a rear segment 66 located between the front sidewall 52*a* of the bit retainer access port 52 and the rear surface 28. In this regard, the rear segment 66 includes a rear wall 68, a left wall 70 extending from the rear wall to the front sidewall 52*a*, and a right wall 71 opposite the left wall and extending also from the rear wall to the front sidewall. The thickness of the rear wall 68 is on the order of at least the thickness 90 (FIG. 5) of the bit holder' block between the bit bore 50 and the apex 44, whereas the left and right walls 70, 71 have a thickness on the order of at least one-half the bit bore to apex distance 90. Accordingly, the rear segment 66 provides, adjacent the retainer access port 52, regional structural strength for the bit block holder 12 at the general location of the application of the fulcrum moment force $F_f$. As a result, a long life of the bit holder block 12 can be expected, without structural fatigue, cracking or distortion occurring.

It should noted that since the cutter bit 14 is located in the bit bore 50 by operation of an abutting relationship between the annular abutment surface 58 and the bit abutment face 40, there is no need for locating structure rearward of the rear opening 50*b* of the bit bore. It is thus made clear that the present invention provides the rear segment 66 in order to assuage the fulcrum moment force $F_f$ in accordance with applicants' theory of force distribution as enunciated hereinabove.

To those skilled in the art to which this invention appertains, the above described preferred embodiment may be subject to change or modification. For example, the exact angles and dimensions of the surfaces of the bit holder block may be varied, but nonetheless a rear segment would be included therewith as generally defined herein. Such change or modification can be carried out without departing from the scope of the invention, which is intended to be limited by the scope of the appended claims.

What is claimed is:

1. A bit holder block for receivably holding a cutter bit in a fixed predetermined orientation with respect thereto, said bit holder block being connectable to a rotary member, said bit holder block comprising:

a foot portion for providing connection to a rotary member, said foot portion comprising:

a front surface; a rear surface opposite said front surface; a left surface extending between said front and rear surfaces; a right surface opposite said left surface and extending between said front and rear surfaces; a bottom surface contiguous said front, rear, left and right surfaces; and a bit holder portion integrally connected with said foot portion, said bit holder portion having a bit bore formed therein, said bit holder portion comprising:

a bit abutment face substantially contiguous said front surface, said bit bore having a forward opening formed at said bit abutment face, said bit bore being oriented perpendicularly with respect to said bit abutment face; a top surface extending between said rear surface and said bit abutment face, said top surface having an apex; a bit retainer access port formed in said bit holder portion at said top surface, said bit retainer access port having a front sidewall and an opposite rear sidewall, said bit bore having a rear opening formed at said front sidewall of said bit retainer access port wherein said bit bore communicates with said bit retainer access port;

and a rear segment extending between said front sidewall of said bit retainer access port and said rear surface, said rear segment comprising: a rear wall located between said rear sidewall and said rear surface; a left wall located between said rear sidewall and said front sidewall; and a right wall opposite said left wall and located between said rear sidewall and said front sidewall;

wherein said rear segment is structured for providing structural support for said bit holder portion to resist force applied to said bit bore adjacent said rear opening thereof in a direction toward said apex.

2. The bit holder block of claim 1, wherein said bit bore is separated from said apex a predetermined distance; wherein said rear wall of said rear segment has a thickness equal to at least substantially said predetermined distance; and further wherein each of said left and right walls has a thickness equal to substantially at least one-half said predetermined distance.

3. The bit holder block of claim 1, further comprising a bore extending in a direction substantially perpendicular to said bit retainer access port and said bit bore, said bore extending from said right wall to said left wall of said rear segment.

4. The bit holder block of claim 3, wherein said bore is in communication with said bit retainer access port.

5. A bit holder block and cutter bit combination, said bit holder block being connectable to a rotary member, said bit holder block and cutter bit combination comprising: a bit holder block comprising: a foot portion for providing connection to a rotary member, said foot portion comprising: a front surface; a rear surface opposite said front surface; a left surface extending between said front and rear surfaces; a right surface opposite said left surface and extending between said front and rear surfaces; and a bottom surface contiguous said front, rear, left and right surfaces; and a bit holder portion integrally connected with said foot portion, said bit holder portion having a bit bore formed therein, said bit holder portion comprising: a bit abutment face substantially contiguous said front surface, said bit bore having a forward opening formed at said bit abutment face, said bit bore being oriented perpendicularly with respect to said bit abutment face; a top surface extending between said rear surface and said bit abutment face, said top surface having an apex; a bit retainer access port formed in said bit holder portion at said top surface, said bit retainer access port having a forward sidewall and an opposite rear sidewall, said bit bore having a rear opening formed at said front sidewall of said bit retainer access port wherein said bit bore communicates with said bit retainer access port; and a rear segment extending between said front sidewall of said bit retainer access port and said rear surface, said rear segment comprising: a rear wall located between said rear sidewall and said rear surface; a left wall located between said rear sidewall and said front sidewall; and a right wall opposite said left wall and located between said rear sidewall and said front sidewall; a cutter bit comprising: a head having a cutting tip; an elongated body having a forward end and a rear end, said forward end being connected with said head opposite said tip thereof, said elongated body having a first cross-section, said head having a second cross-section at said connection of said elongated body thereto, said second cross-section exceeding said first cross-section; an annular abutment surface formed at said connection of said elongated body to said head between said first and second cross-sections thereof, respectively; and an annular groove formed in said elongated body adjacent said rear end thereof; and a retainer clip for releasably engaging said annular groove of said elongated body, said retainer clip being structured to be receivable within said bit retainer access port; wherein said elongated body is receivable in said bit bore; wherein when said elongated body is fully received in said bit bore said annular abutment surface abuts said bit abutment face, said annular groove is located in said bit retainer access port, said rear end of said elongated body is spaced from said rear sidewall, and said retainer clip is engaged on said annular groove to interferingly abut said front sidewall to thereby prevent said elongated body from being extracted from said bit bore; and wherein said rear segment is structured for providing structural support for said bit holder portion to resist force applied to said bit bore adjacent said rear opening thereof in a direction toward said apex.

6. The bit holder block and cutter bit combination of claim 5, wherein said bit bore is separated from said apex a predetermined distance; wherein said rear wall of said rear segment has a thickness equal to substantially at least said predetermined distance; and further wherein each of said left and right walls has a thickness equal to substantially at least one-half said predetermined distance.

7. The bit holder block and cutter bit combination of claim 5, further comprising a bore extending in a direction substantially perpendicular to said bit retainer access port and said bit bore, said bore extending from said right wall to said left wall of said rear segment.

8. The bit holder block and cutter bit combination of claim 5, wherein said bore is in communication with said bit retainer access port.

9. A bit holder block for receivably holding a cutter bit in a fixed predetermined orientation with respect thereto, said bit holder block being connectable to a rotary member, said bit holder block comprising: a foot portion for providing connection to a rotary member, said foot portion comprising: a front surface; a rear surface opposite said front surface; a left surface extending between said front and rear surfaces; a right surface opposite said left surface and extending between said front and rear surfaces; and a bottom surface contiguous said front, rear, left and right surfaces; and a bit holder portion integrally connected with said foot portion, said bit holder portion having a bit bore formed therein, said bit holder portion comprising: a bit abutment face substantially contiguous said front surface, said bit bore having a forward opening formed at said bit abutment face, said bit bore being oriented perpendicularly with respect to said bit abutment face; a top surface extending between said rear surface and said bit abutment face, said top surface having an apex; a bit retainer access port formed in said bit holder portion at said top surface, said bit retainer access port having a front sidewall and an opposite rear sidewall, said bit bore having a rear opening formed at said front sidewall of said bit retainer access port wherein said bit bore communicates with said bit retainer access port; and a rear segment extending between said front sidewall of said bit retainer access port and said rear surface, said rear segment comprising: a rear wall located between said rear sidewall and said rear surface; a left wall located between said rear sidewall and said front sidewall; and a right wall opposite said left wall and located between said rear sidewall and said front sidewall;

wherein said rear segment is structured for providing structural support for said bit holder portion to resist force applied to said bit bore adjacent said rear opening thereof in a direction toward said apex; and wherein said bit bore is separated from said apex a predetermined distance; wherein said rear wall of said rear segment has a thickness equal to substantially at least said predetermined distance; and further wherein each of said left and right walls has a thickness equal to substantially at least one-half said predetermined distance.

10. The bit holder block of claim 9, further comprising a bore extending in a direction substantially perpendicular to said bit retainer access port and said bit bore, said bore extending from said right wall to said left wall of said rear segment.

11. The bit holder block of claim 10, wherein said bore is in communication with said bit retainer access port.

* * * * *